US005188137A

United States Patent [19]

Simonelli

[11] Patent Number: 5,188,137

[45] Date of Patent: Feb. 23, 1993

[54] UMBRELLA

[76] Inventor: Anthony F. Simonelli, 111 Waldron Ave., Cranston, R.I. 02910

[21] Appl. No.: 749,674

[22] Filed: Aug. 26, 1991

[51] Int. Cl.[5] ..... A45B 13/00

[52] U.S. Cl. ..... 135/19.5; 135/25.1; 135/26; 135/28; 135/39

[58] Field of Search ..... 135/16–18, 135/19.5, 25.1, 20.3, 31, 28, 25.41, 25.4, 26, 37–39

[56] References Cited

U.S. PATENT DOCUMENTS

| | | | |
|---|---|---|---|
| 167,070 | 8/1875 | Colby et al. | 135/17 |
| 558,867 | 4/1896 | Waples, Jr. | 135/17 |
| 629,460 | 7/1899 | Nagell | 135/17 |
| 1,349,281 | 8/1920 | King | 135/19.5 X |
| 3,435,836 | 4/1969 | Vanzini | 135/22 |
| 4,084,600 | 4/1978 | dePolo | 135/19.5 X |
| 4,821,756 | 4/1989 | England | 135/19.5 |
| 4,842,003 | 6/1989 | Baldwin et al. | 135/19.5 |
| 4,934,394 | 6/1990 | Hermanson | 135/19.5 |

FOREIGN PATENT DOCUMENTS

| | | | |
|---|---|---|---|
| 1429394 | 1/1966 | France | 135/19.5 |

*Primary Examiner*—David A. Scherbel
*Assistant Examiner*—Lan M. Mai
*Attorney, Agent, or Firm*—Michael I. Kroll

[57] ABSTRACT

An improved umbrella is provided which consists of an elongated hollow shaft having an open top. A collapsible canopy is carried on the elongated hollow shaft. A mechanism is for operating the canopy so that when the canopy is placed in a closed position it will be stored within the open top of the elongated hollow shaft and when the canopy is placed in an opened position the canopy will extend outwardly form the open top over the elongated hollow shaft.

10 Claims, 3 Drawing Sheets (ALTERNATIVE RIB STRUCTURE)
SPRING STEEL
PLASTIC

OPTIONAL (FIG. 5)

UMBRELLA

BACKGROUND OF THE INVENTION

1. Field of the Invention

The instant invention relates generally to weather protection devices and more specifically it relates to an improved umbrella.

2. Description of the Prior Art

Numerous weather protection devices have been provided in prior art that are adapted to include cloth coverings held above people or objects, so as to protect the people or objects from various weather conditions. While these units may be suitable for the particular purpose to which they address, they would not be as suitable for the purposes of the present invention as heretofore described.

SUMMARY OF THE INVENTION

A primary object of the present invention is to provide an improved umbrella that will overcome the shortcomings of the prior art devices.

Another object is to provide an improved umbrella in which a collapsible canopy is stored within an elongated hollow shaft when the canopy is placed in a closed position.

An additional object is to provide an improved umbrella in which a fabric cover is pulled down over the elongated hollow shaft to simulate a collapsed canopy when the canopy is placed in the closed position.

A further object is to provide an improved umbrella that is simple and easy to use.

A still further object is to provide an improved umbrella that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figures 1, 1A, 2, 2A, 3, 4, 5:
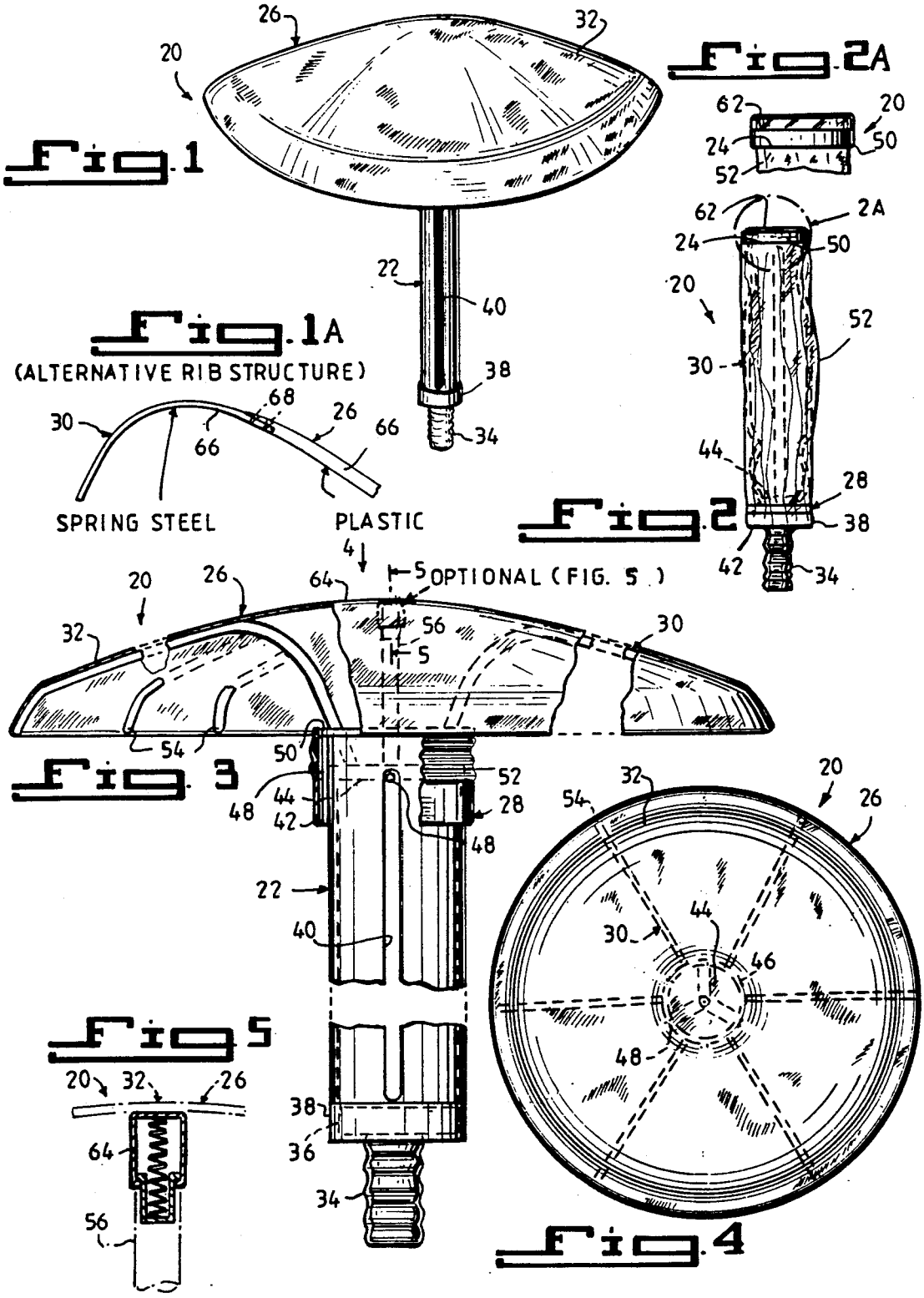
FIG. 1 is a perspective view of the instant invention in an opened position.
FIG. 1A is a side view with parts broken away showing a first alternative rib structure.
FIG. 2 is a elevational view showing the instant invention in a closed position.
FIG. 2A is an enlarged view as indicated by arrow 2A in FIG. 2, showing the ring cap in greater detail.
FIG. 3 is an elevational view of the instant invention in the opened position with parts broken away.
FIG. 4 is a top view taken in direction of arrow 4 in FIG. 3.
FIG. 5 is a cross sectional view taken along line 5—5 in FIG. 3, showing a spring biased cap member on the top center rod.
Figure 6:
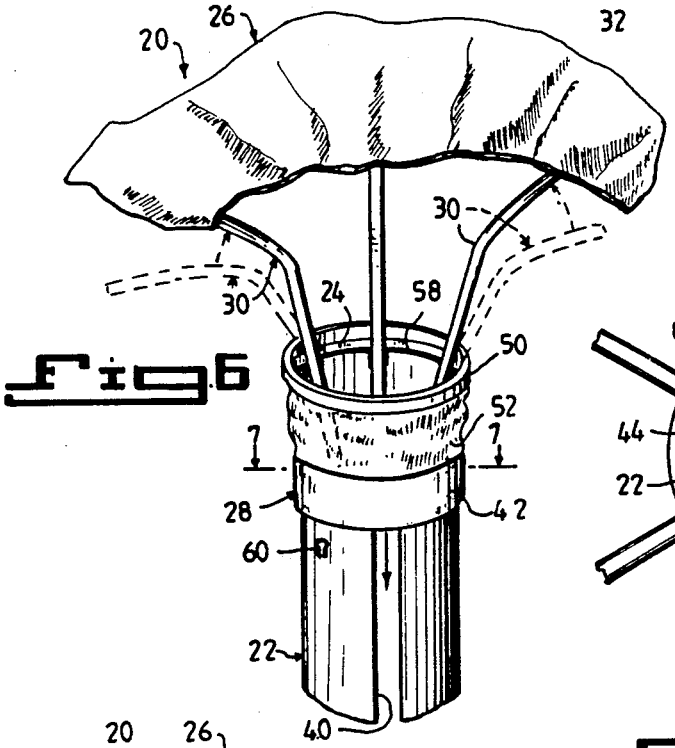
FIG. 6 is a perspective view with parts broken away of the instant invention.
Figure 7:
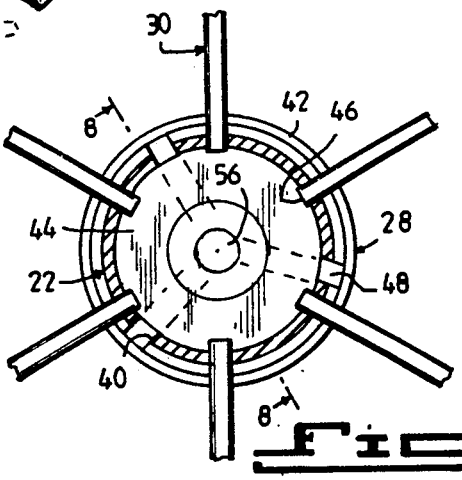
FIG. 7 is a diagrammatic cross sectional view taken along line 7—7 in FIG. 6.
Figure 8:
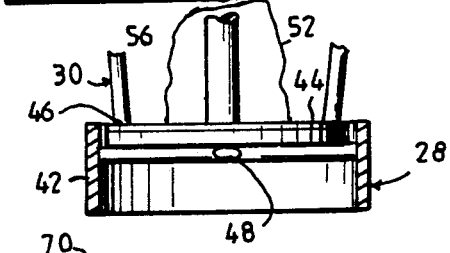
FIG. 8 is a diagrammatic cross sectional view taken along line 8—8 in FIG. 7.
Figure 9:
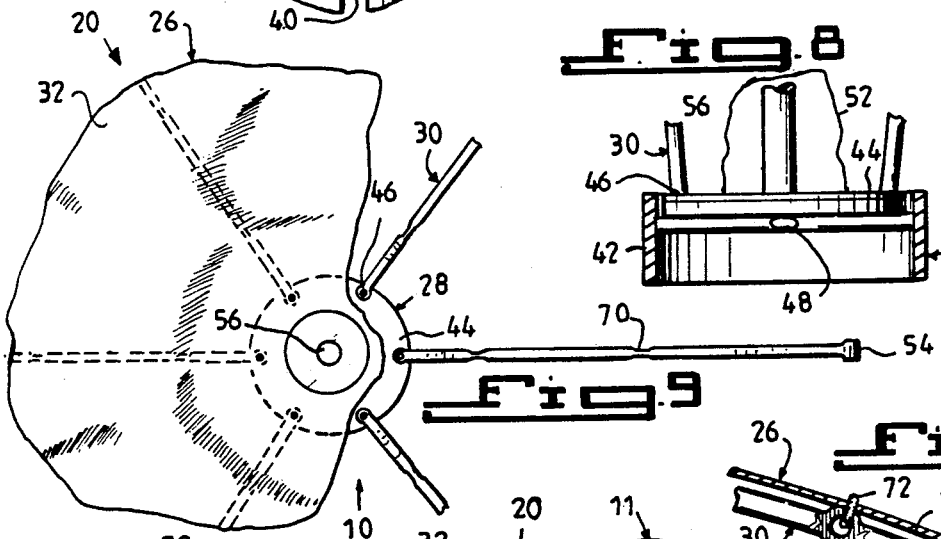
FIG. 9 is a top view with parts broken away showing second alternative rib structures and a first alternative base member.
Figure 11:
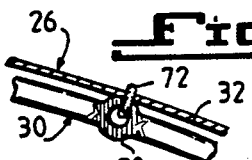
FIG. 11 is an enlarged view as indicated by arrow 11 in FIG. 10 showing one of the tying eyelets on one of the second alternative rib structures.
Figure 10:
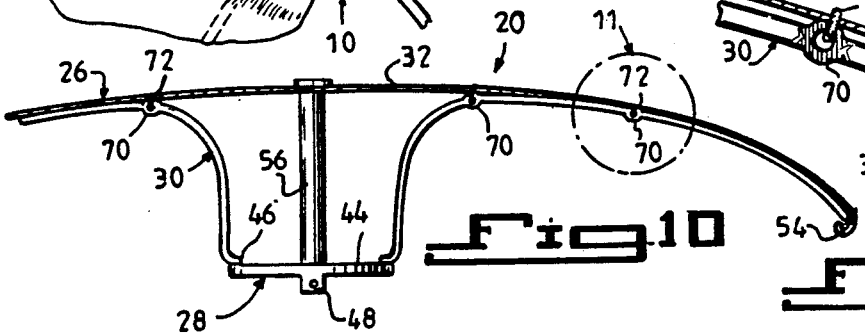
FIG. 10 is a view taken in direction of arrow 10 in FIG. 9.
Figure 12:
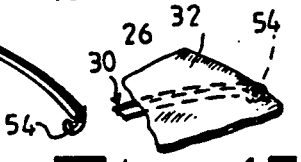
FIG. 12 is a perspective view of a portion of the canopy cover and a forward end of one of the second alternative rib structures.
Figure 13:
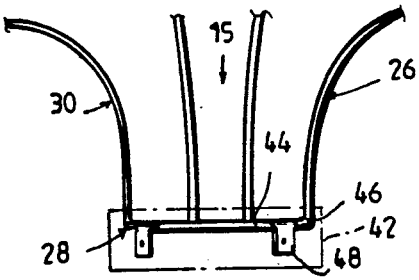
FIG. 13 is an elevational view of a second alternative base member.
Figure 14:
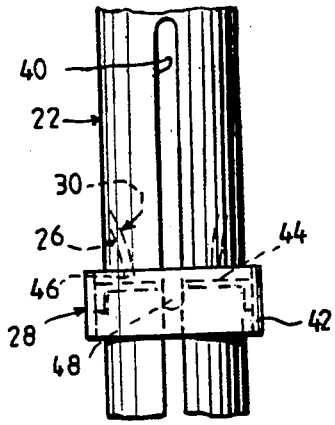
FIG. 14 is an elevational view of a portion of the shaft showing the runner with the second alternative base member installed therein.
Figure 15:
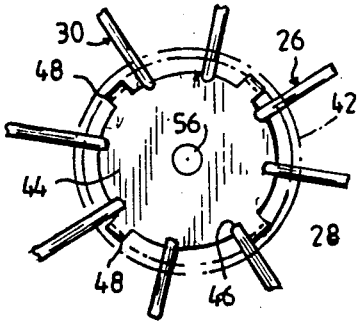
FIG. 15 is a top view taken in direction of arrow 15 in FIG. 13.
Figure 16:
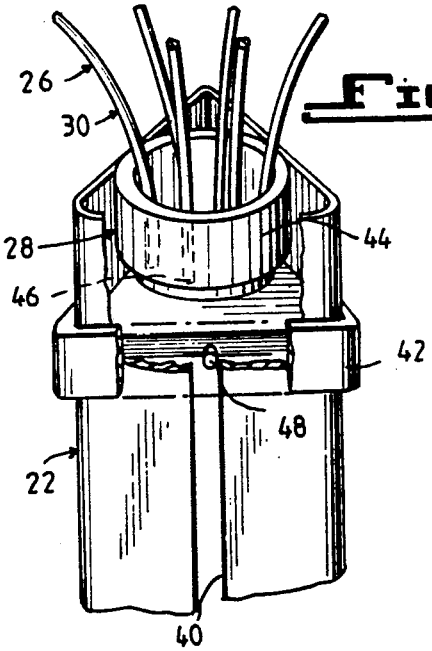
FIG. 16 is a perspective view with parts broken away showing a third alternative base member and runner carried on a corresponding shaft.
Figure 17:
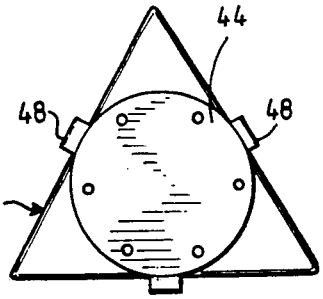
FIG. 17 is a top view of a fourth alternative base member.
Figure 18:
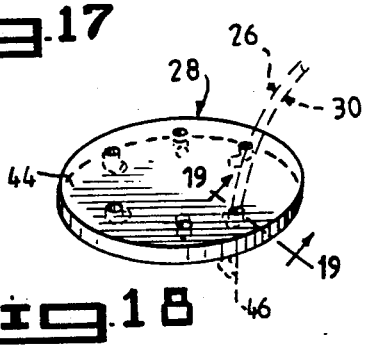
FIG. 18 is a perspective view of the plate portion of the fourth alternative base member.
Figure 19:
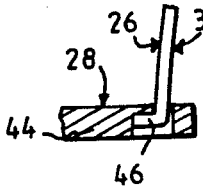
FIG. 19 is a cross sectional view taken along line 19—19 in FIG. 18 showing one of the rib retaining apertures in the plate in greater detail.

Turning now descriptively to the drawings, in which similar reference characters denote similar elements throughout the several views, the Figures illustrate an improved umbrella 20 which consists of an elongated hollow shaft 22 having an open top 24. A collapsible canopy 26 is carried on the elongated hollow shaft 22. A mechanism 28 is for operating the canopy 26, so that when the canopy 26 is placed in a closed position it will be stored within the open top 24 of the elongated hollow shaft 22 and when the canopy 26 is placed in an opened position, the canopy 26 will extend outwardly from the open top 24 over the elongated hollow shaft 22.

The collapsible canopy 26 includes a plurality of radially spaced apart flexible ribs 30 and a fabric covering 32 affixed to the ribs 30. The ribs 30 are spring steel and can assume a bent position with the flexible canopy 32 when the umbrella is closed.

The elongated hollow shaft 22 includes a handle member 34 having a connector portion 36 for attachment to the distal end 38 of the elongated hollow shaft 22 opposite from the collapsible canopy 26. A person can grip the handle member 34 and hold the elongated hollow shaft 22 upright with the canopy 26 placed over the person in an opened position.

The operating mechanism 29 includes the elongated hollow shaft 22 having a plurality of longitudinal spaced apart slots 40. A runner 42 is sized to slide on the elongated hollow shaft 22. A base member 44 is sized to slide within the elongated hollow shaft 22, with the distal ends 46 of the flexible ribs 30 secured to the base member 44 through the open top 24 of the elongated hollow shaft 22. A plurality of spaced apart fingers 48 extend from the base member 44 to the runner 42 with each finger 48 riding within one of the longitudinal slots 40 in the elongated hollow shaft 22. When the runner 42 is pulled down on the elongated hollow shaft 22, the canopy 26 will collapse and enter the top 24 of the elongated hollow shaft 22. When the runner 42 is pushed up on the elongated hollow shaft 22, the canopy 26 will open up and extend over the top 24 of the elongated hollow shaft 22.

A stationary collar 50 is mounted to the open top 24 of the elongated hollow shaft 22 and is sized to overhang therefrom. A collapsible fabric sleeve 52 has a first end affixed to the bottom of the overhang of the stationary collar 50 and a second end affixed to the top of the runner 42. When the runner 42 is pulled down on the elongated hollow shaft 22, the fabric sleeve 52 will extend over the elongated hollow shaft 22 to simulate a standard collapsed canopy. When the runner 42 is pushed up on the elongated hollow shaft 22, the fabric sleeve 52 will bunch up thereon.

Each rib 30 further includes an end tip 54 integral therewith, so as to prevent loss of end tip 54. A top center rod 56 extends upwardly from the base member 44, so as to support the center of the canopy 26 when in its opened position. The elongated hollow shaft 22 has an annular inner notch 58 at the open top 24 thereof to receive the end tip 54 of each rib 30 when the canopy 26 is in the closed position.

A tab 60 is formed on the elongated hollow shaft 22 and located thereon, so that when the runner 42 is pushed up on the elongated hollow shaft 22, said tab 60 will engage with the bottom edge of the runner 42 to keep the runner 42 in its up position until the tab 60 is depressed to release the runner 42. A ring cap 62 can be affixed to the top of the stationary collar 50, so that the improved umbrella 20 can be used as a walking stick when the canopy 26 is in its closed position. A spring biased cap 64 can be mounted to the top of the top center rod 56, so as to provide tension to the fabric covering 32. Each rib 30 can be fabricated out of two segments 66 attached together at 68 and be of two different types of flexible materials, such as spring steel and plastic. Each rib 30 can further include at least one eyelet 70 formed intermittently therein, so that the fabric covering 32 can be tied to the at least one eyelet 70 at 72 for securement thereto.

Each finger 48 in some instances can be radially affixed to the base member 44, while each finger 48 in some instances can be radially integral with the base member 44. Each rib 30 in some instances can be radially affixed to the base member 44, while each rib 30 in some instances can be radially integral with the base member 44.

List of Reference Numbers

20 : improved umbrella
22 : elongated hollow shaft
24 : open top on 12
26 : collapsible canopy
28 : operating mechanism
30 : flexible rib
32 : fabric covering
34 : handle member
36 : connector portion
38 : distal end of 22
40 : longitudinal slot in 22
42 : runner
44 : base member
46 : distal end of 30
48 : finger
50 : stationary collar
52 : collapsible fabric sleeve
54 : end tip on 30
56 : top center rod
58 : annular inner notch at 24
60 : tab 60
62 : ring cap on 50
64 : spring biased cap on 56
66 : segment of 30
68 : attachment for 66
70 : eyelet on 30
72 : tie It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An improved umbrella which comprises:

a) an elongated hollow shaft having an open top, said elongated hollow shaft includes a handle member having a connector portion for attachment to the distal end of said elongated hollow shaft opposite from said collapsible canopy so that a person can grip said handle and hold said elongated hollow shaft upright with said canopy placed over the person in an opened position;

b) a collapsible canopy carried on said elongated hollow shaft, said collapsible canopy includes a plurality of radially spaced apart flexible ribs and a fabric covering affixed to said ribs; and c) means for operating said canopy so that when said canopy is placed in a closed position it will be stored within the open top of said elongated hollow shaft and when said canopy is placed in an opened position said canopy will extend outwardly from the open top over said elongated hollow shaft, said operating means includes said elongated hollow shaft having a plurality of longitudinal spaced apart slots, a runner sized to slide on said elongated hollow shaft, a base member sized to slide within said elongated hollow shaft with the distal ends of said flexible ribs secured to said base member through the open top of said elongated hollow shaft, and a plurality of spaced apart fingers extending from said base member to said runners with said elongated hollow shaft so that when said runner is pulled down on said elongated hollow shaft said canopy will collapse and enter the top of said elongated hollow shaft and when said runner is pushed up on said elongated hollow shaft said canopy will open up and extend over the top of said elongated hollow shaft.

2. An improved umbrellas as recited in claim 1, further including:

a) a stationary collar mounted to the open top of said elongated hollow shaft and sized to overhand therefrom; and b) a collapsible fabric sleeve having a first end affixed to the bottom of the overhang of said stationary collar and a second end affixed to the top of said runner, so that when said runner is pulled down on said elongated hollow shaft said fabric sleeve will extend over said elongated hollow shaft to simulate a standard collapsed canopy and when said runner is pushed up on said elongated hollow shaft said fabric sleeve will bunch up thereon.

3. An improved umbrella as recited in claim 2, wherein each said rib further includes an end tip integral therewith, so as to prevent loss of said end tip.

4. An improved umbrella as recited in claim 3, further including a top center rod extending upwardly from said base member, so as to support the center of said canopy when in its opened position.

5. An improved umbrella as recited in claim 4, further including said elongated hollow shaft having an annular inner notch at the open top thereof to receive said end tip of each said rib when said canopy is in the closed position.

6. An improved umbrella as recited in claim 5, further including a tab formed on said elongated hollow shaft and located thereon so that when said runner is pushed up on said elongated hollow shaft, said tab will engage with the bottom edge of said runner to keep said runner in its up position until said tab is depressed to release said runner.

7. An improved umbrella as recited in claim 6, further including a ring cap affixed to the top of said stationary collar so that said improved umbrella can be used as a walking stick when said canopy is in its closed position.

8. An improved umbrella as recited in claim 7, further including a spring biased cap mounted to the top of said top center rod so as to provide tension to said fabric covering.

9. An improved umbrella as recited in claim 7, wherein each said finger is radially integral with said base member.

10. An improved umbrella as recited in claim 7, wherein each said rib is radially integral with said base member.

* * * * *